US006217280B1

(12) United States Patent
Little

(10) Patent No.: US 6,217,280 B1
(45) Date of Patent: Apr. 17, 2001

(54) TURBINE INTER-DISK CAVITY COOLING AIR COMPRESSOR

(75) Inventor: David Allen Little, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/039,553

(22) Filed: Mar. 16, 1998

Related U.S. Application Data

(63) Continuation-in-part of application No. 08/730,720, filed on Oct. 7, 1995, now Pat. No. 5,704,764.

(51) Int. Cl.[7] ..... F01D 5/18

(52) U.S. Cl. ..... 415/115; 415/116; 415/117; 415/176; 416/95; 416/96 R; 60/39.07; 60/39.75

(58) Field of Search ..... 415/115, 116, 415/117, 175, 176; 416/95, 96 R, 97 R, 198 A, 200 A, 201 R; 60/39.75, 39.07

(56) References Cited

U.S. PATENT DOCUMENTS

| | | | | |
|---|---|---|---|---|
| 2,648,519 | | 8/1953 | Campini . | |
| 3,826,084 | | 7/1974 | Branstrom et al. . | |
| 4,456,427 | * | 6/1984 | Evans et al. | 416/95 |
| 4,910,958 | * | 3/1990 | Kreitmeier | 60/39.75 |
| 5,120,192 | | 6/1992 | Ohtomo et al. . | |
| 5,226,785 | * | 7/1993 | Narayana et al. | 415/115 |
| 5,269,653 | | 12/1993 | Evans . | |
| 5,394,687 | | 3/1995 | Chen et al. . | |
| 5,468,125 | | 11/1995 | Okpara et al. . | |
| 5,507,620 | | 4/1996 | Primoschitz et al. . | |
| 5,593,274 | | 1/1997 | Carreno et al. . | |
| 5,611,197 | | 3/1997 | Bunker . | |

FOREIGN PATENT DOCUMENTS

| | | |
|---|---|---|
| 0 313 826 | 5/1989 | (EP) . |
| 2 042 643 | 8/1980 | (GB) . |
| WO 97/49902 | 12/1997 | (WO) . |

* cited by examiner

*Primary Examiner*—Christopher Verdier
(74) *Attorney, Agent, or Firm*—Eckert Seamans Cherin & Mellott, LLC

(57) ABSTRACT

A combustion turbine may have a cooling circuit for directing a cooling medium through the combustion turbine to cool various components of the combustion turbine. This cooling circuit may include a compressor, a combustor shell and a component of the combustion turbine to be cooled. This component may be a rotating blade of the combustion turbine. A pressure changing mechanism is disposed in the combustion turbine between the component to be cooled and the combustor shell. The cooling medium preferably flows from the compressor to the combustor shell, through a cooler, the component to the cooled and the pressure changing mechanism. After flowing through the pressure changing mechanism, the cooling medium is returned to the combustor shell. The pressure changing mechanism preferably changes the pressure of the cooling medium from a pressure at which it is exhausted from the component to be cooled to approximately that of the combustor shell.

13 Claims, 9 Drawing Sheets

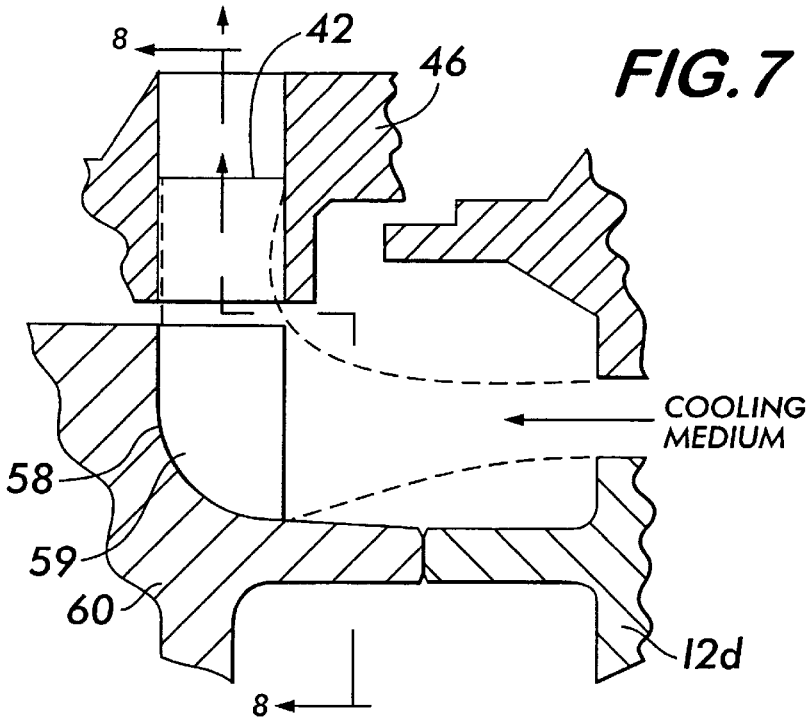
FIG. 7
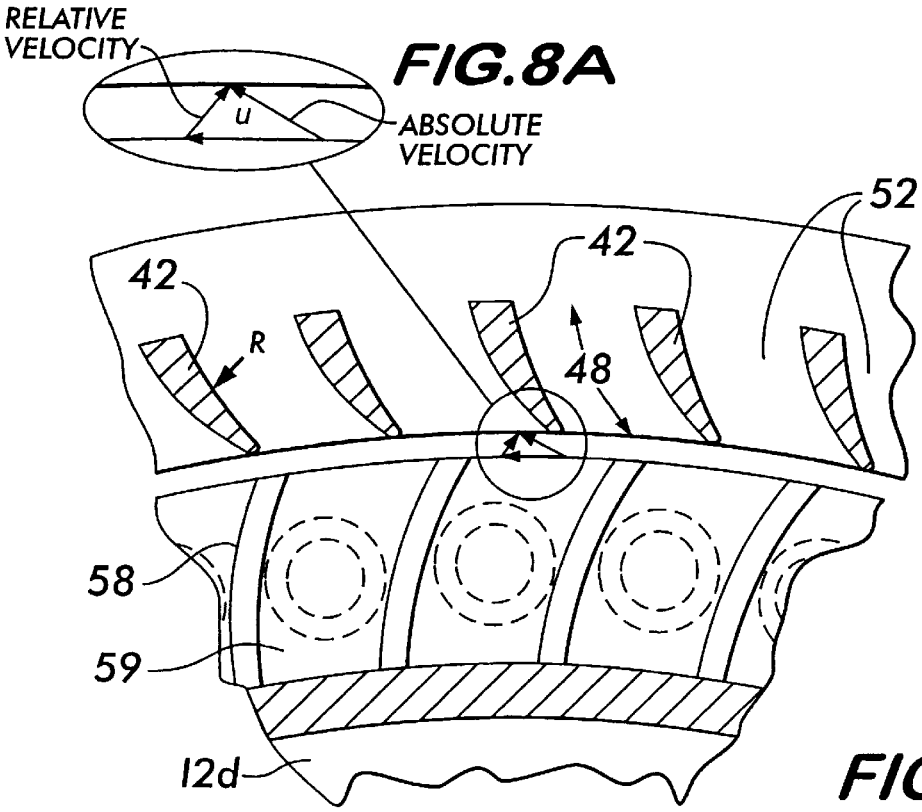
FIG. 8A
FIG. 8

FIG.10
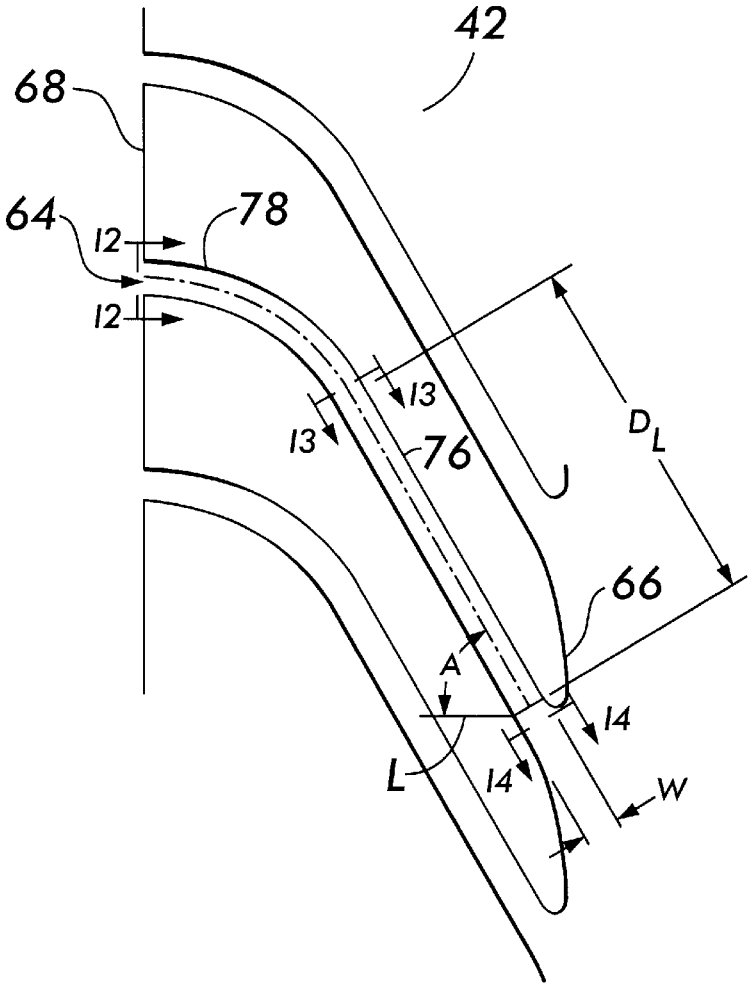
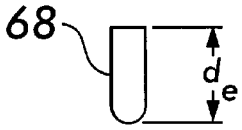
FIG.12
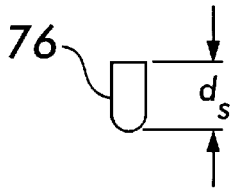
FIG.13
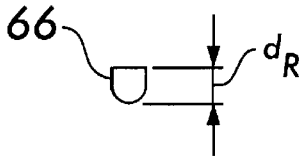
FIG.14
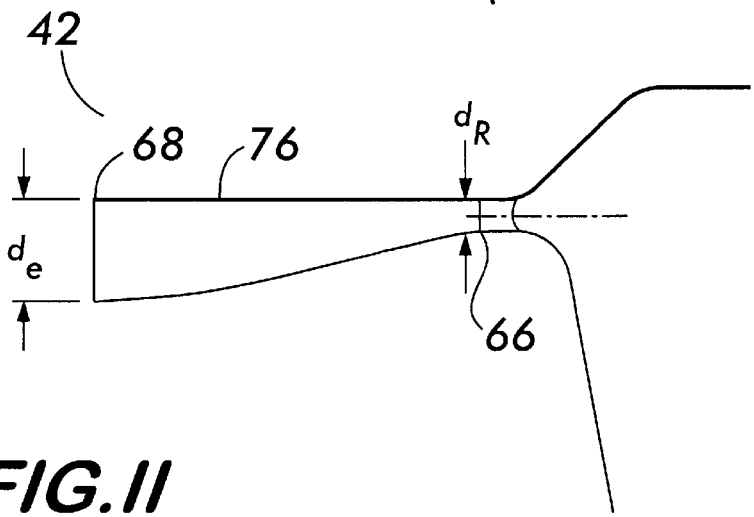
FIG.11

TURBINE INTER-DISK CAVITY COOLING AIR COMPRESSOR

RELATED APPLICATION

This application is a continuation-in-part of commonly assigned patent application Ser. No. 08/730,720, filed Oct. 7, 1995, now U.S. Pat. No. 5,704,764, issued Jan. 6, 1998.

The United States Government has rights in this invention pursuant to Contract No. DE-AC21-93M30247 with the Department of Energy.

FIELD OF THE INVENTION

The invention relates to cooling systems for use with turbine engines. More particularly, the invention relates to pressure changing mechanisms disposed in turbine engines for changing the pressure of a cooling medium that is flowing through the turbine engine. This invention also relates to methods and systems that employ the pressure changing mechanisms.

BACKGROUND OF THE INVENTION

Pressurized air is among the more common cooling mediums used to cool various components in gas turbine engines. Generally in such systems, compressed air is drawn from the combustor shell and traverses a closed loop cooling system in which the air cools components of the turbine engine, e.g., the vanes, the blades and the combustors. Typically, the air is first filtered and cooled before its use as a coolant. After being cooled, the air is directed to the components to be cooled, and then the air is returned to the discharge of the compressor or the combustor shell of the gas turbine engine.

In such a closed loop system, the cooling air must be sufficiently pressurized in order to re-enter the combustor shell or mix with the air discharged from the compressor. Unfortunately, within the cooling circuit, the air generally experiences a pressure loss. This pressure loss is caused by the resistance of bends, orifices and other obstructions. To overcome these pressure drops and increase the pressure of the cooling medium to approximately that of the combustor shell or the discharge of the compressor, the air coolant, in some applications, is routed out of the turbine engine to an external compressor before it is returned to the combustion turbine and eventually the combustor shell. In the external compressor, the air coolant may be compressed about 60 PSI. Significantly, external compressors are expensive components, with costs in the $300,000 range. Other costs are associated with the use of external compressors, e.g., back up compressors, piping, operation, maintenance, floor space and the like. Applicants have recognized that a turbine engine that internally provides the pressurization required for the air coolant to reenter the combustor shell would eliminate the need for external compressors, thereby providing substantial economic benefits.

Thus, there is a need for pressure changing mechanisms that function within turbines and compress the cooling medium and thereby eliminate the need for external compressors. There is also a need for improved systems and methods for using the pressure reducing mechanisms that operate within turbines.

SUMMARY OF THE INVENTION

A cooling circuit for a combustion turbine may include a compressor, a combustor shell, an external cooler, a component of the turbine to be cooled and the pressure changing mechanism of this invention. As is conventional with cooling circuits, a cooling medium flows from the compressor to the combustor shell. From the combustor shell, the cooling medium flows through the external cooler and the component of the turbine to be cooled. After flowing through the component of the turbine to be cooled the pressure of the cooling medium is less than that of the combustor shell. Therefore, in order to return the cooling medium to the combustor shell, the pressure of the cooling medium must be raised. This invention includes a pressure changing mechanism disposed within the combustion turbine and within the cooling circuit of the combustion turbine that increases the pressure of the cooling medium from the pressure at which it exits the component to be cooled to approximately the pressure of the combustor shell.

According to one aspect of this invention, the combustion turbine components that are cooled by the cooling circuit are the rotating blades disposed within the turbine section of the combustion turbine. In order to cool the rotating blades, the cooling circuit further includes a flow path defined within the rotating disks of the combustion turbine. In this type of cooling circuit, the cooling medium flows from the combustor shell through the rotating disks and then through the rotating blades. From the rotating blades, the cooling medium then flows through the pressure changing mechanism.

In a preferred embodiment of this invention the pressure changing mechanism includes a plurality of diffusing vanes that are disposed circumferentially around a torque tube casing of the combustion turbine. A diffusing channel is defined between every two diffusing vanes. The diffusing channels receives cooling medium after it has flowed through the rotating disks and blades of the combustion turbine. Preferably, the geometry of each of these diffusing vanes and channels is such that when it receives the cooling medium from each of the rotating blades and disks it increases the pressure of the cooling medium to approximately that of the combustor shell.

In order to change the pressure of the cooling medium, each diffusing vane is preferably curved and each of the diffusing channels has a portion of which has an increasing cross-sectional area. When the cooling medium enters the channels defined by the diffusing vanes it slows down in this portion of the channel that has an increasing cross sectional area. Because of this deceleration and subsequent decrease in velocity, the static pressure of the cooling medium is increased to approximate that of the combustor shell pressure.

In another preferred embodiment of this invention, the pressure changing mechanism includes a ring disposed within the torque tube casing of the combustion turbine. Defined within the ring are a plurality of diffusing channels. These channels are disposed between the rotating blades and the combustor shell so that the cooling medium flows from the rotating blades through the diffusing channels and into the combustor shell. Each of these diffusing channels has a geometry that causes the pressure of the cooling medium to approximate that of the combustor shell. Preferably, each of these diffusing channels has a receiving end and an exhausting end. The receiving end receives coolant from the rotating disks and blades, and the exhausting end exhausts cooling medium to the combustor shell. The cross-sectional area of the receiving end is preferably smaller than the cross-sectional area of the exhausting end, so that the cooling medium diffuses within the diffusing channel, and the static pressure of the cooling medium is thereby increased to approximately that of combustor shell pressure.

Other features of this invention are described below.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

In the drawings:

FIG. 7 is a diagrammatical view of a portion of the system of FIG. 5;

FIG. 8 is a cross-sectional view along line 8—8 of FIG. 7;

FIG. 8A is an enlargement of the cooling air velocity vector diagram shown in FIG. 8;

FIG. 10 is a top view of a preferred embodiment of this invention;

FIG. 11 is a cross-sectional view of the preferred embodiment of FIG. 10;

FIG. 12 is a cross-section taken along line 12—12 of FIG. 10;

FIG. 13 is a cross-section taken along line 13—13; of FIG. 10; and FIG. 14 is a cross-section taken along line 14—14 of FIG. 10.

DETAILED DESCRIPTION OF PREFERRED EMBODIMENTS

Figure 1:
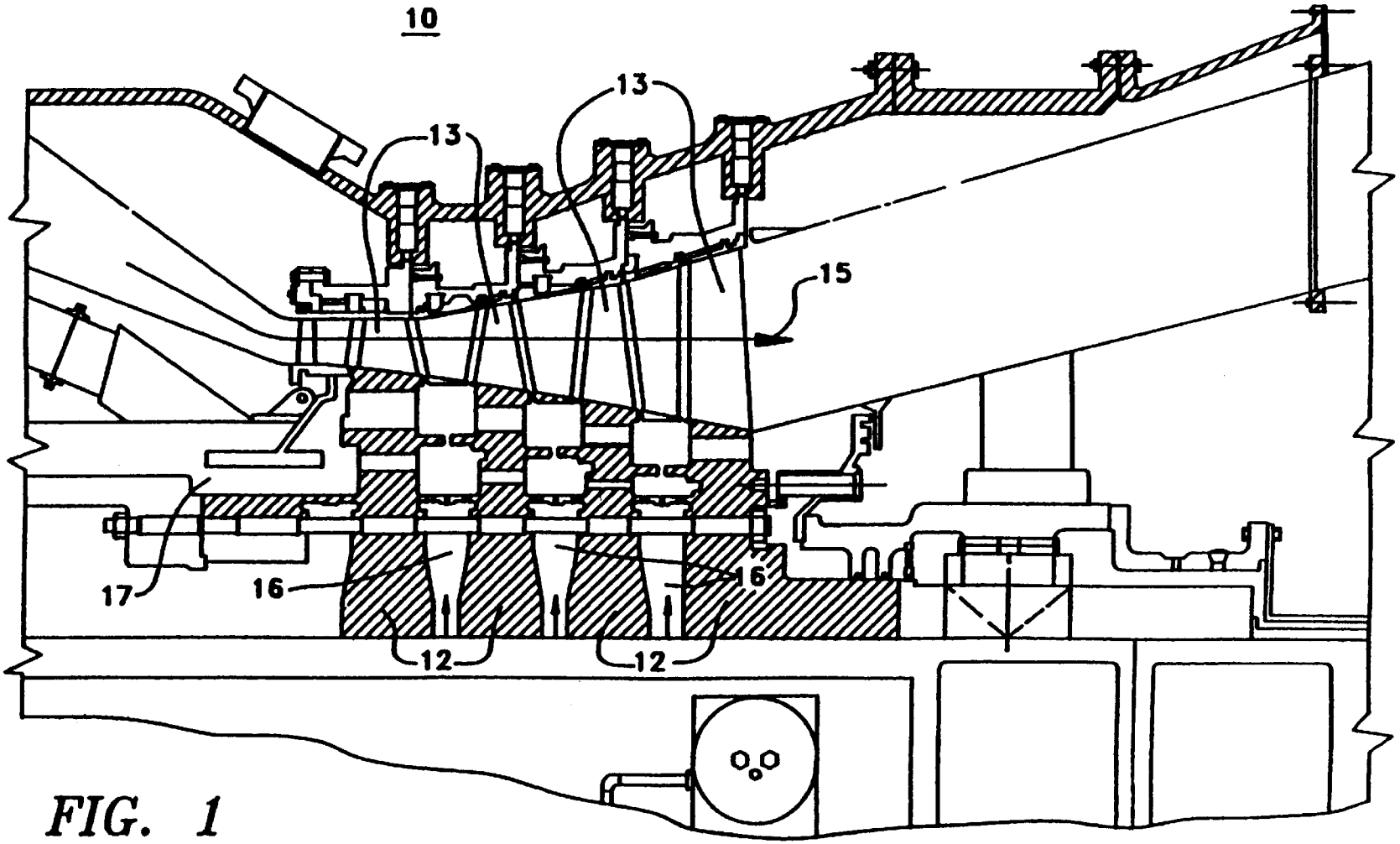
FIG. 1 is a sectional view of a turbine section of a turbine engine wherein the present invention may be employed.

Referring now to the drawings wherein like numerals indicate like elements throughout, FIG. 1 presents a diagram of a turbine 10 portion of a gas turbine or combustion engine wherein the present invention may be employed. As shown in FIG. 1, the turbine 10 comprises a plurality of turbine rotor disks 12. These rotor disks 12 are arranged in parallel planes to form a turbine shaft, which is rotatably disposed within the turbine 10. An inter-disk cavity 16 is formed by the space between the rotor disks 12. The rotor disks 12 can then rotate in tandem within the turbine 10. Rotor blades 13, which are attached to the rotor disks 12, are disposed within the hot gas path 15. As the hot gas expands axially through the turbine 10, the rotor blades 13 and rotor disk 12 assembly are caused to rotate.

Coolant must be provided to the rotor blades 13 as well as other turbine engine components because of the exposure to extreme heat from the hot gas expanding through the turbine 10. In a presently preferred embodiment of the present invention, the coolant comprises air; however, persons skilled in the art will appreciate that other gases or combinations of gases, such as steam, can be substituted for the air without affecting the function or novelty of the present invention.

Figure 1A:
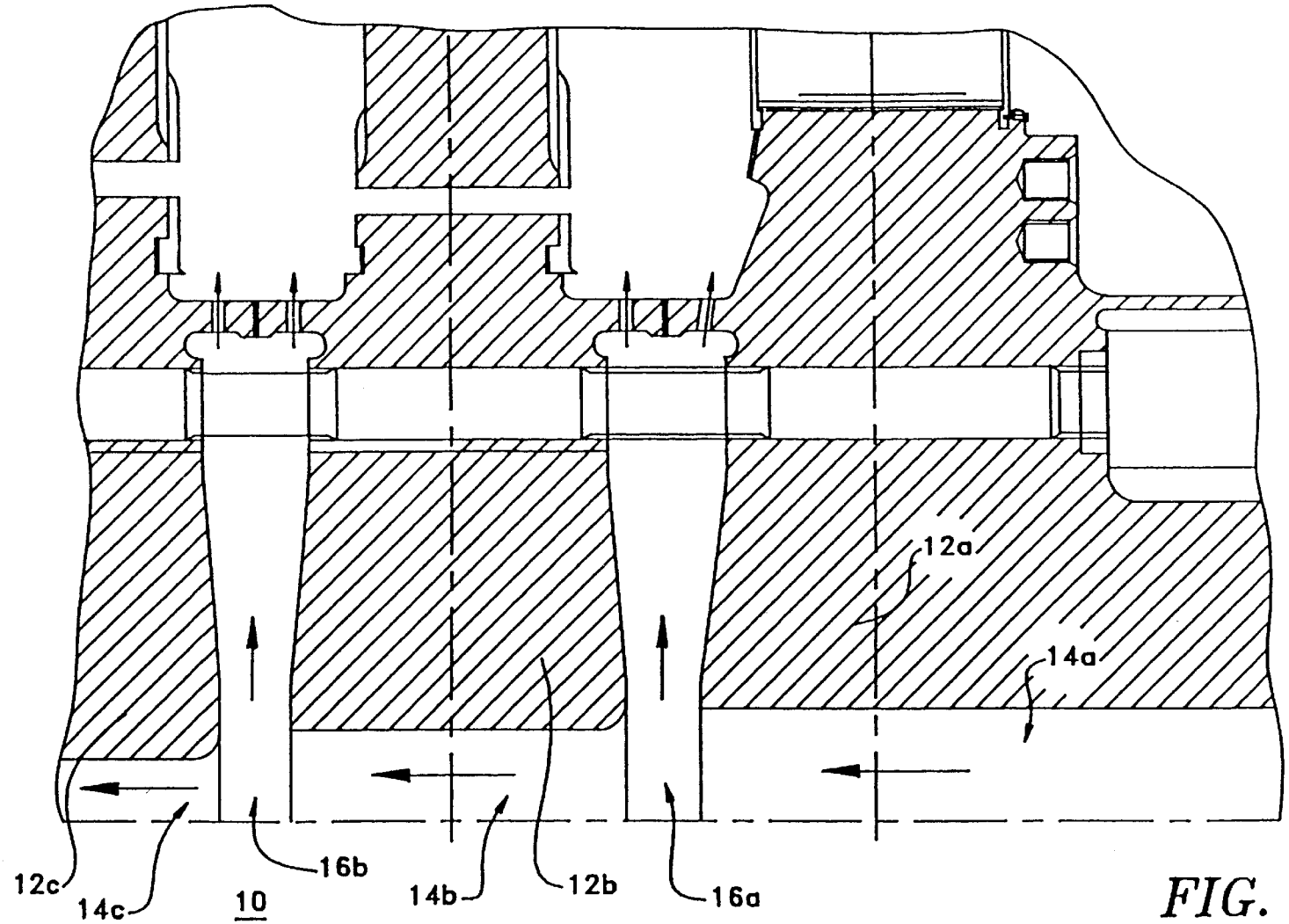
FIG. 1A is a sectional view of a portion of a gas turbine engine showing a portion of the air coolant path.

Referring now to FIG. 1A, the path of the air coolant is shown as it flows through the turbine 10 to reach the rotor blades 13. In the presently preferred embodiment, the air coolant flows through the turbine 10 from the rear of the turbine 10 toward the front of the turbine 10. As will be explained more fully below, along the coolant flow path, a portion of the air coolant is shunted off to provide the coolant needs for each set of rotor blades 13.

The air coolant flows through each rotor disk 12 via a duct 14. In particular, the air coolant enters the last rotor disk 12*a* via duct 14*a*. The air coolant then enters the inter-disk cavity 16*a*. As shown, a portion of the air coolant is shunted outwardly through the inter-disk cavity 16*a* to provide the coolant needs for the rotor blades 13. The remaining air coolant continues travels through the turbine 10 via duct 14*b* in rotor disk 12*b*. After traveling through rotor disk 12*b*, another portion of the air coolant enters the next inter-disk cavity 16*b*. Similarly, this portion of the air is shunted outwardly to provide the cooling needs of the next set of rotor blades 13. Subsequently, another portion of the coolant air enters the next disk 12*c* via duct 14*c*.

As indicated above, the air coolant must be pressurized before entering the rotor blades 13. According to the present invention, the pressurization is provided by the rotor disks 12 and the inter-disk cavity. Essentially, the air coolant enters the inter-disk cavities 16*a*, 16*b*. Therein, the air pressure must be increased to provide pressure higher than compressor discharge pressure at the exit of the cooling circuit 17. According to an aspect of the present invention, the air pressure increase is gained via the rotation of the rotor disks 12.

A series of ridges 30 are disposed within the inter-disk cavities 16 to increase the pressure of the air coolant as it flows outwardly. In the presently preferred embodiments, as explained more fully below, the ridges 30 can be attached to one side of the inter-disk cavity 16, i.e., to only one of the faces of the rotor disk 12, or, alternatively, the ridges 30 can be attached to both sides of the inter-disk cavity 16, i.e., both faces of the rotor disk 12.

Figure 2:
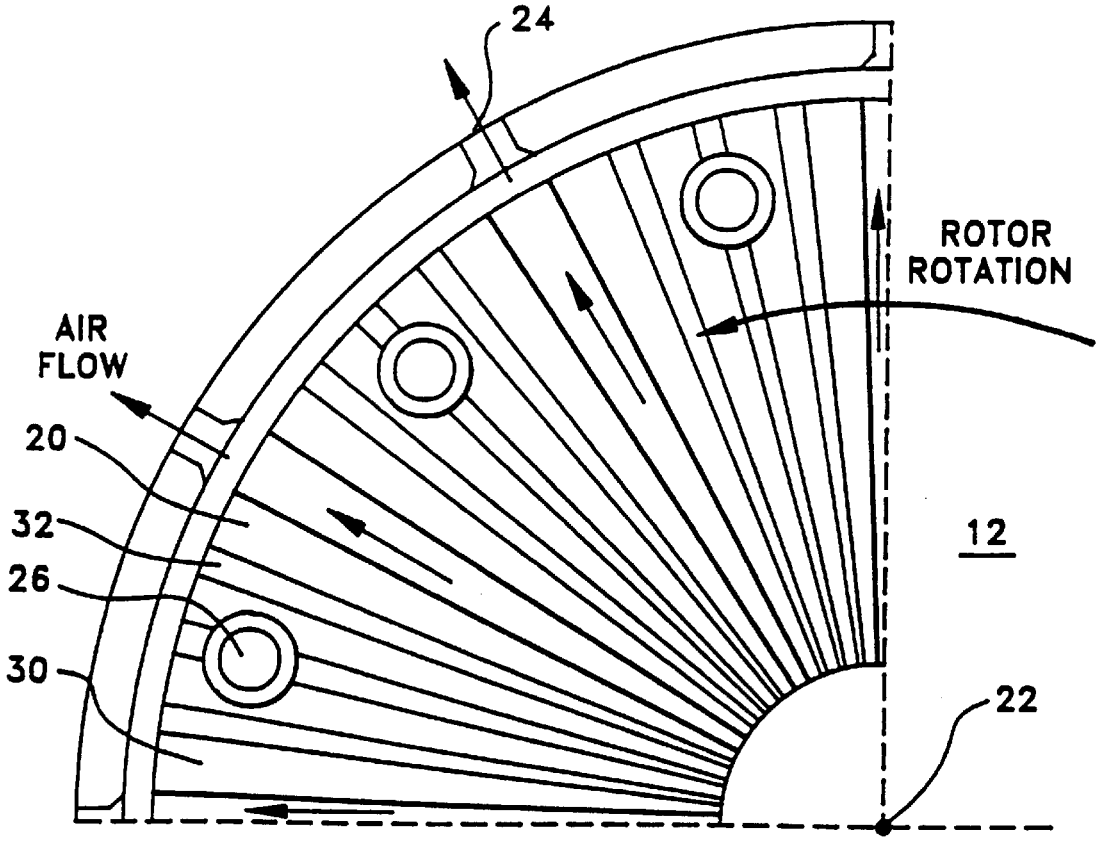
FIG. 2 is a front view of a portion of a rotor disk employing aspects of the present invention.
Figure 3:
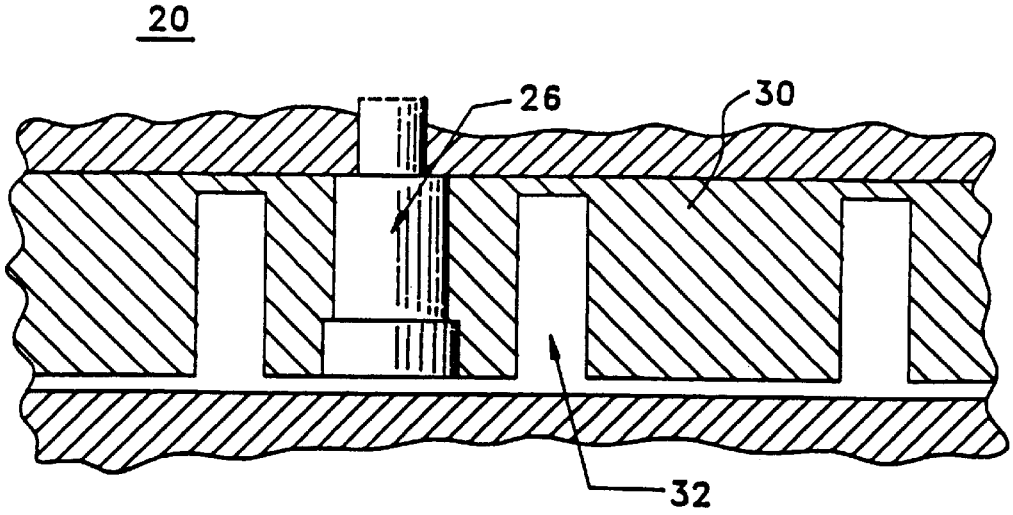
FIG. 3 is a sectional view of a presently preferred embodiment of the present invention within the rotor disk inter-cavity wherein the geometric shape of the ridges is rectangular.

Referring now to FIGS. 2 and 3, the face of a portion of a rotor disk 12 having the ridges 30 of the present invention is depicted. In a presently preferred embodiment, spacers 20 are attached to the face of the rotor disk 12. The spacers 20 are configured with ridges such that as each rotor disk 12 rotates about its axis 22, the pressure of the air coolant flowing out through the inter-disk cavity outlets 24 is increased. The spacers 20 are attached to the rotor disk 12 via thru bolts 26. As best shown in FIG. 3, each spacer 20 comprises a series of ridges 30 that extend radially outward from the center toward the periphery of the rotor disk 12. Those skilled in the art will recognize that the length of the ridges shown in FIG. 3, although depicted with straight lines, may be a variety of shapes, such as curved lines. The cross-section of the ridges 30 shows that the ridges 30 have a rectangular cross-section. Air passages 32 remain between the ridges 30. As the rotor disk 12 rotates about the turbine shaft, the pressure flowing through the air passages 32 is greatly increased, i.e., on the order of 50 psi. Thus, the pressure rise within the inter-disk cavity 16 approaches that of an external compressor.

Figure 4:
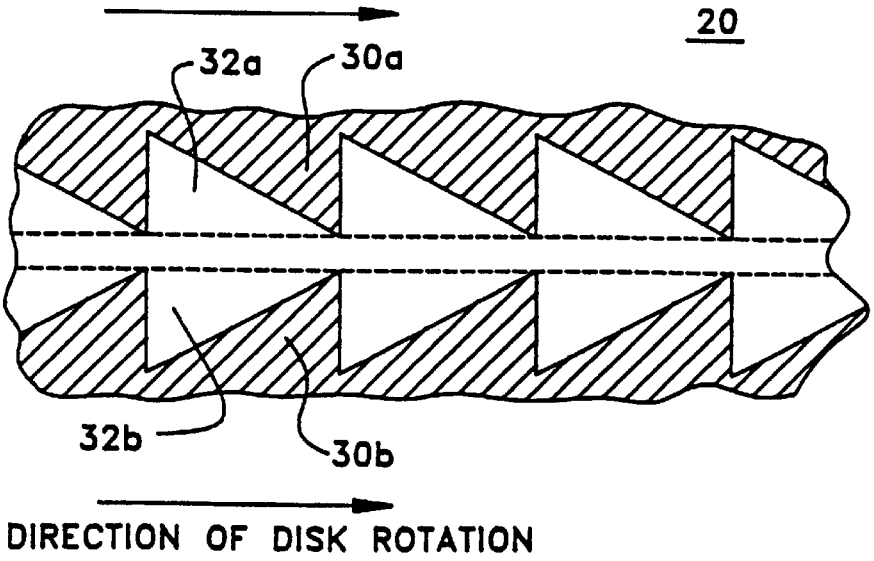
FIG. 4 is a sectional view of a presently preferred embodiment of the present invention within the rotor disk inter-cavity wherein the geometric shape of the ridges is triangular.

Referring now to FIG. 4, another presently preferred embodiment of the present invention is illustrated. As shown, in this embodiment, the ridges 30*a* and 30*b* rise off of both rotor disk faces that form the inter-disk cavity to form air passages 32*a* and 32*b*. Moreover, the ridges 30*a* and 30*b* are not formed of separate spacers that are attached to the face of the rotor disk 12, but rather are formed as part of the face of the rotor disk 12. The rotor disk 12 can be machined to create the ridges 30*a* and 30*b* with the desired cross-section or, alternatively, cast as a single rotor disk 12 having ridges 30*a* and 30*b* with the desired cross-section.

Figure 5:
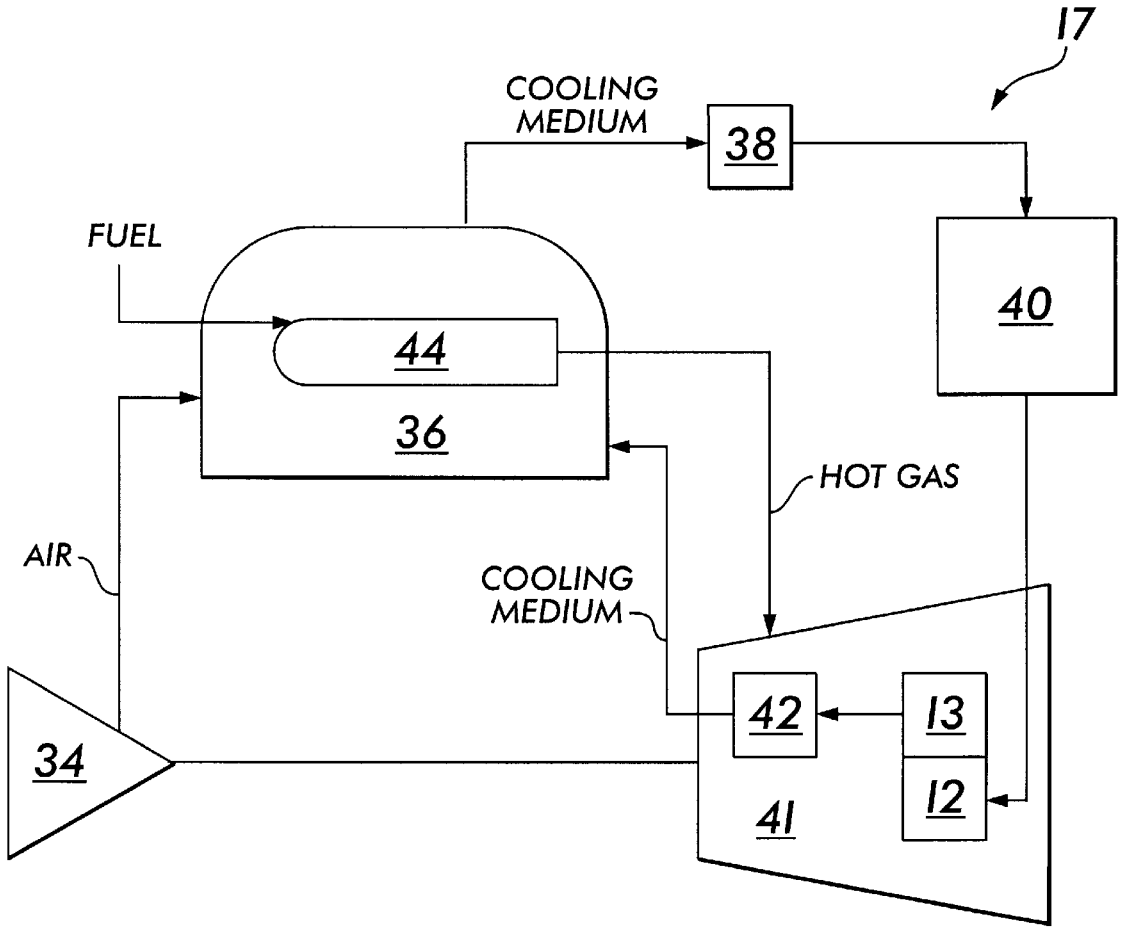
FIG. 5 is a schematic diagram of a preferred embodiment of the system of this invention.

FIG. 5 is a schematic diagram of a preferred embodiment of a cooling circuit 17 of this invention. As shown, the cooling circuit 17 may include a compressor 34, a combustor shell 36, a filter 38, an external cooler 40, the rotating disks 12*a*, 12*b*, 12*c* of the turbine section 41 and a pressure changing mechanism 42 of this invention, which is described in more detail below. As is conventional, the compressor 34 produces compressed air that may be used as the cooling medium. This compressed air is exhausted into the combustor shell 36. From the combustor shell 36, the compressed air is directed to the filter 38 and the external cooler 40. The filter 38 removes impurities from the cooling medium, and the cooling medium is cooled by the external cooler 40. From the external cooler 40, the cooling medium may be directed to the rotating disks 12*a*, 12*b*, 12*c* and blades 13 of the turbine 10, where the cooling medium removes heat from the rotating discs 12*a*, 12*b*, 12*c* and blades 13. After the cooling medium has been heated, the cooling medium may be directed to the pressure changing mechanism 42 of this invention where the pressure of the cooling medium is increased to approximate that of the combustor shell 36. After the pressure changing mechanism 42, the cooling medium flows to the combustor shell 36. In the combustor shell 36, the cooling medium mixes with air exhausted from the compressor and is directed either back through the cooling circuit 17 or to the combustor 44, of the turbine.

Because the cooling medium mixes with the compressed air exhausted by the compressor 34, it must have a pressure that approximates that of the air in the combustor shell 36. In a preferred embodiment of this invention, the pressure changing mechanism 42 increases the pressure of the cooling medium exhausted from the rotating disks 12*a*, 12*b*, 12*c* and blades 13 to approximate the pressure of the air in the combustor shell 36. In a preferred embodiment of this invention, the pressure changing mechanism 42 is employed in a 501 Advanced Turbine System (ATS) manufactured by Westinghouse Electric Corporation. In this embodiment, the pressure changing mechanism 42 increases the pressure of the cooling medium about 25 psi. to a pressure of about 395 psia. Since the pressure of the combustor shell 36 is preferably about 390 psia., the pressure of the cooling medium after flowing through the pressure changing mechanism 42 approximates that of the combustor shell 36. These specific pressures are not intended to be limiting, and provided by way of example and to explain the operation of a preferred embodiment of this invention.

According to a preferred embodiment of this invention, the turbine may have a torque tube casing 46. This torque tube casing is stationary within the turbine. A portion of the cooling circuit 17 is defined within the torque tube casing. Preferably, the pressure changing mechanism 42 is disposed within the torque tube casing 46 so that the cooling medium can flow from the rotating disks 12*a*, 12*b*, 12*c* and blades 13 to the pressure changing mechanism 42. After flowing through the torque tube casing 46, the cooling medium preferably flows to the combustor shell 36 of the combustion turbine where it mixes with air that has been compressed by the compressor 34.

Provided below is a description of two embodiments of the pressure changing mechanism 42 of this invention. Although two embodiments of the pressure changing mechanism 42 are provided, this invention is not limited to these two embodiments and may include other pressure changing mechanisms 42 disposed within the turbine 10 that change the pressure of the cooling medium to approximate that of the combustor shell 36.

The pressure changing mechanism 42 of this invention may be employed with or without the pressurization caused by the rotating disks described above. That is, the pressure changing mechanism 42 may be employed with rotating disks that do not have the ridges 30 or the spacers 20 described above or with the described rotating disks that do have ridges 30 and/or spacers 20. Except as indicated, the discussion provided below is with reference to a cooling circuit 17 that employs rotating disks that have spacers 20 and/or ridges 30.

Figure 6:
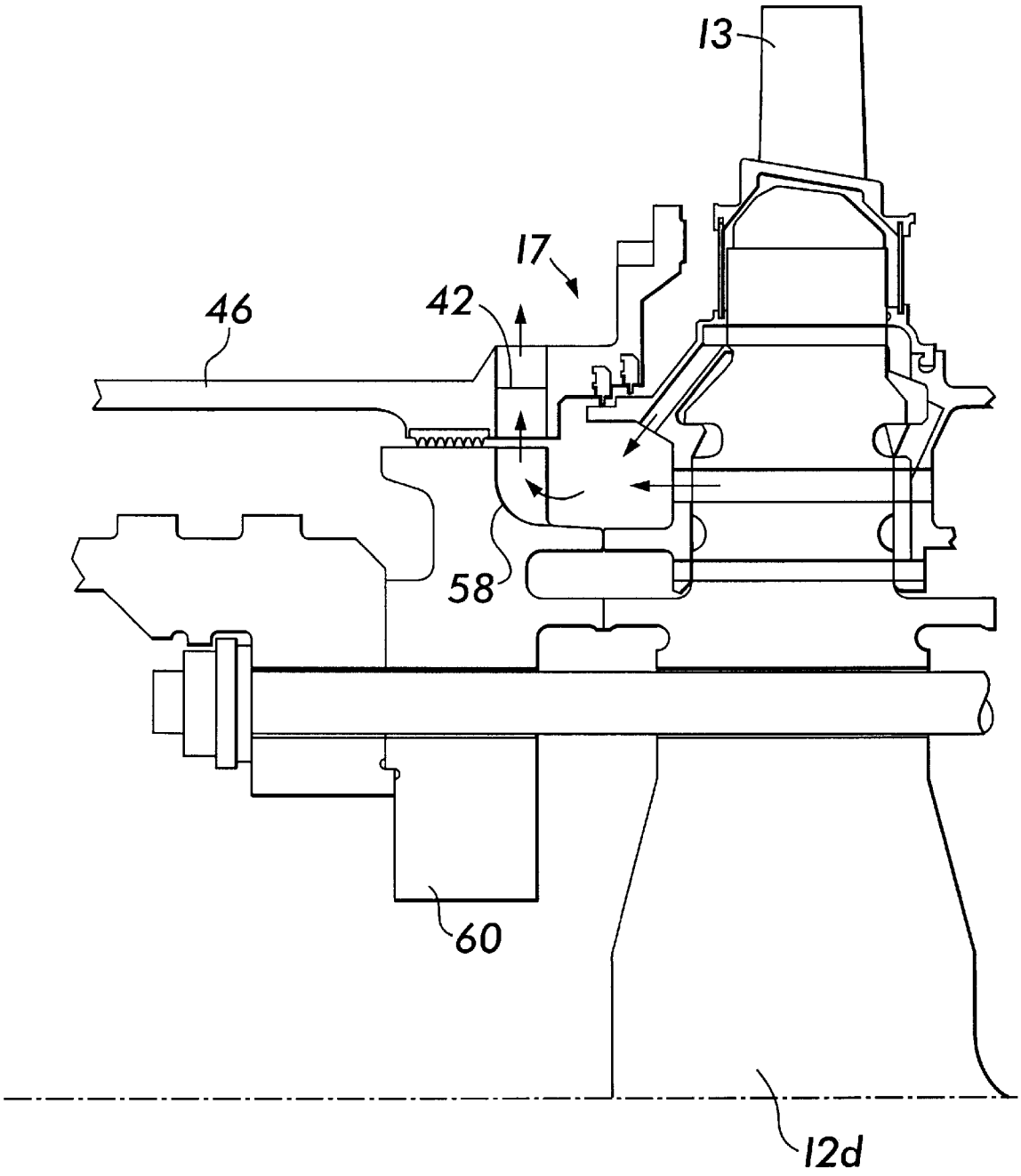
FIG. 6 is a diagrammatical view of a preferred embodiment of a portion of the system of FIG. 5.
Figure 9:
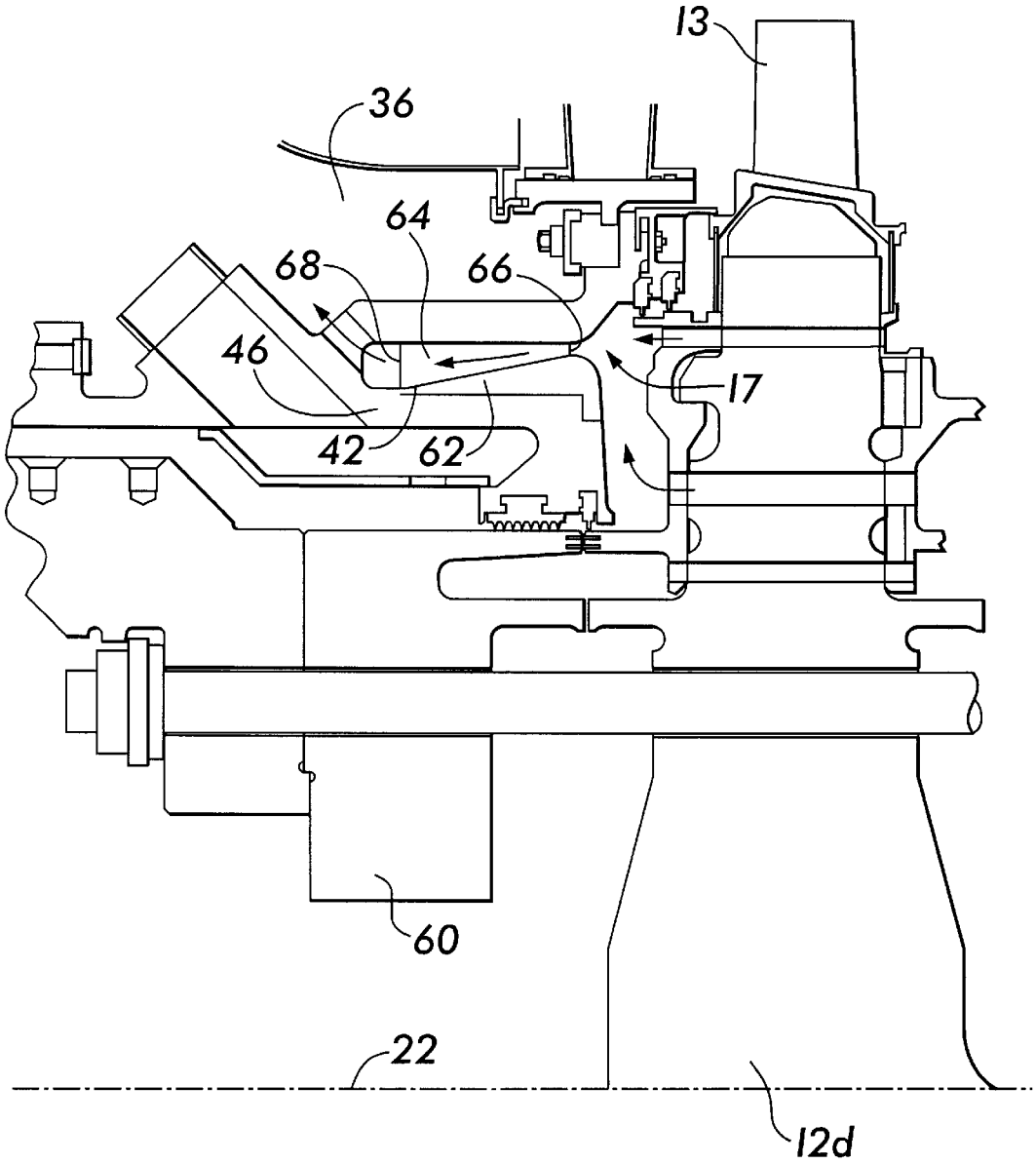
FIG. 9 is a diagrammatical view of a preferred embodiment of a portion of the system of FIG. 5.

A preferred embodiment of the pressure changing mechanism 42 of this invention is shown in FIGS. 6–8. In this embodiment, the pressure changing mechanism 42 includes a plurality of diffusing vanes. The diffusing vanes preferably have a curved shape. Although only one diffusing vane is shown in FIG. 6, it will be understood that a combustion turbine 10 may have a plurality of similar diffusing vanes disposed circumferentially around the torque tube casing, as shown in FIG. 8. Preferably, each diffusing vane is spaced about the same radial distance from the centerline of the combustion turbine. A diffusing channel 52 is defined in between every two diffusing vanes. Each of these channels 52 is disposed proximal to the rotating disk 12*d* so that the channels may receive cooling medium that has flowed through the rotating disks 12*a*, 12*b*, 12*c*, 12*d* and the rotating blades 13.

Each of the diffusing vanes is shaped so that when the cooling medium flows through the channels 52 defined by the respective diffusing vanes the pressure of the cooling medium increases. This increase in pressure is due to the shape of the diffusing vanes and channels 52. The diffusing vanes and channels are shaped such that at least a portion 48 of each of the diffusing channels 52 has an increasing cross-sectional area. Because of this increasing cross-sectional area portion 48 of the diffusing channels 52, the cooling medium slows down as it travels through the diffusing channels. As the cooling medium slows down and decelerates, the pressure, and in particular the static pressure, of the cooling medium increases. Most preferably, the geometry of the diffusing vanes and channels 52 are such that the pressure of the cooling medium increases to approximate that of the combustor shell. After flowing through the diffusing channels, the cooling medium flows to the combustor shell.

A plurality of flow guiding blades 58 may be disposed between the rotating disks and the diffusing vanes. Preferably, these flow guiding blades 58 are disposed circumferentially around the turbine 10 in the spacer disc 60 and are approximately equally spaced from the radius of the centerline of the turbine 10. A flow guiding passage 59 is defined in between each of the flow guiding blades 58. Cooling medium exhausted from the rotating disk 12*d* is directed to these flow guiding passages 59. As the cooling medium flows through the flow guiding passages, the flow guiding blades 58 direct the flow of the cooling medium exhausted from the rotating disks to the diffusing vanes. Preferably, they redirect the flow of the cooling medium from generally in the axial direction to generally in the radial direction, as shown in FIG. 7.

The manner in which the pressure of the cooling medium is increased is better understood with reference to FIGS. 8 and 8A. As described above, the cooling medium travels through the cooling path defined within the rotating disks and rotating blades 13. As the cooling medium flows through the rotating blades and disks, it removes heat from the rotating disks and rotating blades 13. Furthermore, as the cooling medium flows through the rotating disks and blades, the cooling medium decreases in pressure due primarily to friction losses. After flowing through the cooling path defined within the disks and blades as described above, the cooling medium exits the disks and blades and flows through the flow guiding passages 59 defined by the flow guiding blades 58. When the cooling medium exits the flow guiding blades 59, the cooling medium exits with an absolute velocity and a relative velocity. The approximate direction of these velocities is labeled in FIG. 8. The cooling medium is generally flowing in a radial direction as it exits the flow guiding passages 59. As shown, the stationary diffusing vanes are constructed so that the cooling medium will flow through the diffusing channels due to the direction of its absolute velocity. While flowing through the diffusing channels, the cooling medium slows down and increases in pressure. Thus, by constructing the diffusing vanes such that the cooling medium will slow down as it exits the cooling path defined within the rotating disks, the diffusing vanes cause the pressure of the cooling medium to be increased.

In another preferred embodiment of this invention, the pressure changing mechanism 42 includes a ring 62 disposed within the torque tube casing that has a plurality of diffusing channels 64. A preferred embodiment of the ring 62 and channels 64 are shown in FIGS. 9–14. Preferably, the combustion turbine has a plurality of similar diffusing channels 64 disposed circumferentially around the torque tube casing 46. The ring 62 may be machined to form the diffusing channels 64. As shown the diffusing channels 64 preferably have a geometry that will increase the pressure of the cooling medium exhausted from the rotating disks 12*a*, 12*b*, 12*c*, 12*d* to approximate the pressure of the combustor shell 36. In a preferred embodiment, the diffusing channels 64 have a receiving end 66 and an exhausting end 68. The receiving end 66 receives cooling medium exhausted from the rotating disks 12*a*, 12*b*, 12*c*, 12*d* and blades 13 and the exhausting end 68 exhausts the cooling medium after it has flowed through the diffusing channels 64 and directs the cooling medium to the combustor shell 36. Preferably, the depth $d_r$ of the receiving end 66 is smaller than the depth $d_e$ of the exhausting end 68. Moreover, it is preferable that the diffusing channels 64 have at least a portion 76 that has a gradually increasing depth or cross-sectional area. These depths or areas are selectively chosen to increase the pressure of the cooling medium from its initial pressure when it is received from the rotating disks 12*a*, 12*b*, 12*c*, 12*d* to approximately the pressure of the combustor shell 36. In a preferred embodiment, the portion 76 of each channel 64 that has a gradually increasing depth or cross-sectional area is the entire diffusing channel 64.

The diffusing channels 64 increase the pressure of the cooling medium received from the rotating disks 12*a* 12*b*, 12*c*, 12*d* as follows. The cooling medium exits the rotating disks 12*a*, 12*b*, 12*c*, 12*d* and blades with a directional velocity due to the rotation of the rotating disks that is generally in the tangential direction of the turbine. This pressure at which the cooling medium exists the rotating blades and disks is less than the combustor shell pressure. From the rotating disks 12*a*, 12*b*, 12*c*, 12*d* the coolant enters the diffusing channels 64. In the diffusing channels 64, the cooling medium decelerates due to the geometry of the diffusing channels 64, and the pressure of the cooling medium is thereby increased. This occurs because of the increasing cross-sectional area of the diffusing channel. Furthermore, the cooling medium changes its direction as it is funneled into the channels 64 and impinges against the channels 64.

In a preferred embodiment of this invention, the dimensions of the diffusing channels are as follows. The depth $d_r$ of the receiving end is about 13.2 mm., and the depth $d_e$ of the exhausting end is about 40.7 mm. The depth $d_s$ of the channel at the end of the straight portion is about 28.9 mm. Preferably, the angle A at which the centerline of the channel is disposed is about 60 degrees relative to a line L that is parallel to the centerline of the turbine. The width w of the channel is preferably about 13.2 mm., and the length $D_l$ of the straight portion is preferably about 150.0 mm.

As mentioned above, the pressure changing mechanism 42 of this invention may be employed in a cooling circuit 17 that has spacers 20 and/or ridges 30. When employed with rotating disks that have ridges 30 or spacers 20 for increasing the pressure of the cooling medium, the pressure changing mechanism 42 further increases the pressure of the cooling medium over the increase provided by the rotating disks. It will be appreciated that the geometry of either or both of the pressure changing mechanism 42 or the ridges/spacers 30, 20 of the rotating disks may have to be adjusted to obtain the appropriate change in the pressure of the cooling medium depending on the application in which they are employed.

In summary, the pressure changing mechanism 42 of this invention changes the pressure of a cooling medium flowing within a cooling circuit 17 of a combustion turbine 10. Preferably, the pressure changing mechanism 42, increases the pressure of the cooling medium from the pressure at which the cooling medium is exhausted from the rotating disks and blades to a pressure of the combustor shell 36 of the combustion turbine 10.

By providing a pressure changing mechanism 42 within a combustion turbine 10 in combination with the spacers 20 and/or ridges 30, the need for an external compressor in a combustion turbine cooling circuit 17 is eliminated. Potentially, this may result in economic benefits due to decreased capital expenditures and maintenance costs associated with external compressors.

Although the preferred embodiments of this invention are described with reference to air as the cooling medium, it will be understood that other cooling mediums may be employed with this invention and the cooling circuit 17 may vary depending on the cooling medium employed. This invention is intended to include pressure changing mechanisms 42 disposed initially within a combustion turbine 10 that change the pressure of a cooling medium as it flows through a cooling circuit 17 of a combustion turbine 10.

The present invention may be embodied in other specific forms without departing from the spirit or essential attributes thereof. For example, square ridges or some other shaped ridge cross-section could be used to generate the inter-disk cavity pressure. Accordingly, reference should be made to the appended claims, rather than to the foregoing specification, as indicating the scope of the invention.

What is claimed is:

1. A turbine cooling system for cooling a turbine component, comprising:

a stationary torque tube casing disposed in a turbine;

a first rotating disk rotatable mounted with the turbine and having a duct for passage of a cooling medium;

a spacer disk disposed within the turbine and a pair of flow guiding blades, disposed in the spacer disk, that define a flow guiding passage for passage of the cooling medium from the first rotating disk to a pressure changing mechanism and for changing a direction of flow of the cooling medium; and, the pressure changing mechanism having a diffusing channel with increasing cross sectional area, disposed in the torque tube casing, for receiving the cooling medium from the duct of the rotatable disk at a first pressure and changing the pressure of the cooling medium to a second pressure and wherein the second pressure has a magnitude that is higher than the first pressure, said turbine cooling system being a closed loop system.

2. The closed loop turbine cooling system of claim 1, wherein the pressure changing mechanism comprises a pair of diffusing vanes that define the diffusing channel.

3. The closed loop turbine cooling system of claim 1, wherein the pressure changing mechanism comprises a ring that has the diffusing channel.

4. The closed loop cooling system of claim 3, wherein the diffusing channel comprises a first end for receiving the cooling medium and a second end for exhausting the cooling medium.

5. The closed loop cooling system of claim 4, wherein the diffusing channel further comprises a first depth at the first end and a second depth at the second end, the second depth being greater in magnitude than the first depth.

6. The closed loop turbine cooling system of claim 1, further comprising a second rotating disk rotatably mounted within the turbine to define an inter-disk cavity between the first rotating disk and the second rotating disk, the inter-disk cavity being for passage of the cooling medium between the duct and the pressure changing mechanism.

7. A closed loop turbine cooling system for cooling a combustion turbine, comprising:

a torque tube casing disposed in the combustion turbine;

at least two rotating disks rotatably mounted to a turbine rotor, the rotating disks being separated by an inter-disk cavity for passage of a cooling medium;

a rotating blade, disposed in the turbine, through which the cooling medium can flow after it has flowed through the inter-disk cavity and thereby cool the rotating blade;

a spacer disk disposed within the turbine and a pair of flow guiding blades disposed in the spacer disk, that define a flow guiding passage for passage of the cooling medium from the rotating blade to a pressure changing mechanism and for changing a direction of flow of the cooling medium; and the pressure changing mechanism having a diffusing channel with increasing cross sectional area, disposed in the torque tube casing, for receiving a cooling medium from the rotating blade, the pressure changing mechanism being for changing the pressure of the cooling medium from a first pressure to a second pressure and wherein the second pressure has a magnitude that is higher than the first pressure.

8. The closed loop turbine cooling system of claim 7, wherein the pressure changing mechanism comprises a pair of diffusing vanes that define the diffusing channel.

9. The closed loop turbine cooling system of claim 7, wherein the pressure changing mechanism comprises a ring that has the diffusing channel.

10. The closed loop cooling system of claim 9, wherein the diffusing channel further comprises a first depth at a first end and a second depth at a second end, the second depth being greater in magnitude than the first depth.

11. The method of claim 12, wherein the pressure changing mechanism comprises a pair of diffusing vanes that define the diffusing channel.

12. A method for converting a cooling medium from a first pressure to a second pressure in a closed loop turbine cooling circuit, comprising:

passing the cooling medium through an inter-disk cavity formed between two rotating disks that are rotatably mounted to a turbine rotor;

changing a direction of flow of the cooling medium transversing the interdisk cavity; and, directing the cooling medium received from one of said rotating disks through a stationary pressure changing mechanism, having a diffusing channel with increasing cross sectional area, for changing the first pressure of the cooling medium to the second pressure and wherein the pressure changing mechanism is disposed on a stationary torque tube casing and the second pressure has a magnitude that is greater than the first pressure.

13. The method of claim 12, wherein the pressure changing mechanism comprises a ring that has the diffusing channel.

* * * * *